US007134442B2

(12) United States Patent
Ma

(10) Patent No.: US 7,134,442 B2
(45) Date of Patent: Nov. 14, 2006

(54) UMBRELLA

(76) Inventor: Oliver Joen-an Ma, 29 W. Wisteria, Arcadia, CA (US) 91007

( * ) Notice: Subject to any disclaimer, the term of this patent is extended or adjusted under 35 U.S.C. 154(b) by 0 days.

(21) Appl. No.: 11/134,074

(22) Filed: May 20, 2005

(65) Prior Publication Data

US 2005/0268952 A1 Dec. 8, 2005

(30) Foreign Application Priority Data

Jun. 3, 2004 (EP) ..... 04076642
Sep. 17, 2004 (CN) ..... 2004 2 0090220

(51) Int. Cl.
*A45B 11/00* (2006.01)

(52) U.S. Cl. ..... 135/20.1; 135/20.3

(58) Field of Classification Search ..... 135/90, 135/21, 98, 20.3, 20.1, 155; 248/299.1, 298.1, 248/295.11, 292.12
See application file for complete search history.

(56) References Cited

U.S. PATENT DOCUMENTS 2,235,518 A * 3/1941 Goshaw ..... 381/91
2,475,406 A 7/1949 Russell
2,661,752 A 12/1953 Kampf et al.
2,905,187 A 9/1959 Croce
3,120,238 A 2/1964 Glatz
3,145,720 A 8/1964 Torii
4,586,525 A 5/1986 Glatz et al.
4,622,987 A 11/1986 Redl et al.
4,674,523 A 6/1987 Glatz
4,697,606 A 10/1987 Ma
4,878,509 A 11/1989 Tung
5,002,081 A 3/1991 Stromeyer
5,029,596 A 7/1991 Tung
5,156,395 A * 10/1992 Smith ..... 473/483
5,161,764 A * 11/1992 Roney ..... 248/231.71
5,349,975 A 9/1994 Valdner
5,499,644 A 3/1996 Geniele
5,584,564 A 12/1996 Phyle
5,611,364 A 3/1997 Woods et al.
5,678,585 A * 10/1997 May ..... 135/20.1
5,785,069 A 7/1998 Glatz (Continued)

FOREIGN PATENT DOCUMENTS

DE 580503 7/1933

(Continued)

OTHER PUBLICATIONS

Operation Manual Easy Sun Parasol Sunshade (Issue: Jul. 2004) pp. 1-17.

*Primary Examiner*—Peter M. Cuomo
*Assistant Examiner*—Noah Chandler Hawk
(74) *Attorney, Agent, or Firm*—Knobbe Martens Olson & Bear LLP

(57) ABSTRACT

An umbrella assembly is provided that comprises a canopy frame, a support pole, an extension mechanism, and a canopy deployment mechanism. The support pole has a first member that has a first end and a second end and a second member. The second member is coupled with the canopy frame and with the first member and is movable relative to the first member between a retracted position and an extended position. The extension mechanism is configured to be driven by a crank handle to move the second member between the retracted position and the extended position. The canopy deployment mechanism is configured to be driven by a crank handle independently of the extension mechanism to open and close the canopy frame.

41 Claims, 12 Drawing Sheets

U.S. PATENT DOCUMENTS

| | | | | |
|---|---|---|---|---|
| D398,443 | S | 9/1998 | Bolle | |
| 5,845,665 | A * | 12/1998 | Koehn | 135/98 |
| 5,937,882 | A | 8/1999 | Harbaugh | |
| 6,014,980 | A | 1/2000 | Glatz | |
| D434,215 | S | 11/2000 | Lin | |
| 6,152,156 | A | 11/2000 | Tung | |
| D434,556 | S | 12/2000 | Lin | |
| 6,220,261 | B1 | 4/2001 | Glatz | |
| 6,311,705 | B1 | 11/2001 | Ma | |
| 6,478,037 | B1 | 11/2002 | Tung | |
| 6,575,182 | B1 | 6/2003 | Tung | |
| 6,575,183 | B1 | 6/2003 | Tung | |
| D477,458 | S | 7/2003 | Goldwitz | |
| 6,588,438 | B1 | 7/2003 | Steiner | |
| 6,619,306 | B1 | 9/2003 | Ma | |
| 6,662,815 | B1 | 12/2003 | Tung | |
| D497,479 | S | 10/2004 | Yu | |
| 6,837,255 | B1 | 1/2005 | Bunch et al. | |
| 6,851,823 | B1 | 2/2005 | Bilotti | |
| 6,953,043 | B1 * | 10/2005 | Yu | 135/20.1 |
| 2002/0083969 | A1 | 7/2002 | Tung | |
| 2002/0104557 | A1 * | 8/2002 | Tung | 135/21 |
| 2003/0010366 | A1 | 1/2003 | Glatz | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0182429 | A1 | 9/2004 | Chen | |

FOREIGN PATENT DOCUMENTS

| | | |
|---|---|---|
| DE | 3229776 | 4/1983 |
| DE | 3820573 A1 | 8/1989 |
| EP | 0 392 989 | 3/1990 |
| GB | 22218 A | 9/1910 |
| WO | WO 00/55456 | 9/2000 |

* cited by examiner

UMBRELLA

BACKGROUND OF THE INVENTION

This application claims priority under 35 U.S.C. §119(a) to Chinese Utility Model No. 200420090220.X, filed Sep. 17, 2004, and to European Patent Application 04076642.0, filed Jun. 3, 2004, both of which are hereby expressly incorporated herein by reference in their entirety.

BACKGROUND OF THE INVENTION

1. Field of the Invention

This application is directed to an umbrella that has a canopy suspended from an extendable support member. In particular, this application is directed to an umbrella that includes extension and deployment mechanisms that can be driven by a crank handle.

2. Description of the Related Art

Umbrellas have been developed to provide shelter from the elements and are particularly useful in outdoor seating areas, such as on a backyard patio. Typically, an umbrella comprises a support pole and a canopy positioned at the top of the pole for providing shade. Basic umbrellas have the support pole centrally located directly beneath the canopy. This construction has several disadvantages. For example, the pole is located at the most sheltered position under the canopy. Also, the pole obstructs the view of persons seated beneath the canopy. Some umbrella designs locate the support pole to the side of the canopy, generally suspending the canopy from above. A disadvantage of these designs is that they take up more space than umbrellas supported from below. A few umbrella designs support a canopy from above and are retractable to reduce the amount of space that they require.

For example, U.S. Patent Application Publication No. 2004/0055628 A1 describes an umbrella that includes upper and lower support rods, ribs, a panel supported by the ribs, and a hand cranking device. The upper rod is located within the lower rod of the retractable device. The hand cranking device is located within a lower portion of the lower support rod. The hand cranking device includes a drive worm gear connected to a handle. Separate driven worm gears are positioned on two sides of the drive worm gear. The driven worm gears separately connect to rotating wheels. Each of the wheels has a rope entwined upon it. One rope is coupled with the ribs and thereby with the panel. The other rope is coupled with the upper support rod. The umbrella is arranged so that the upper rod is extended from the lower rod and the panel is deployed by turning the handle. More particularly, the umbrella is arranged so that turning the handle simultaneously extends the upper rod and then deploys the panel. Reverse operation of the hand crank closes the panel and then retracts the upper rod.

This arrangement is disadvantageous in several respects. For example, the upper support rod apparently has to be fully extended from the lower support rod in order for the ribs and panel to be expanded. This greatly limits the positionability of the umbrella. In particular, this arrangement requires the entire umbrella to be repositioned for changes in position of the sun. Additionally, impairment of one of the extension function and the deployment function will render the umbrella inoperable.

Another design that is commercially available comprises upper and lower support rods, a handle to deploy a canopy, and a locking screw. In this device, the upper and lower support rods are side-by-side and are joined by a figure-8 shaped block. The block includes a tightening screw that clamps the upper support rod to the lower support rod. The canopy is raised by loosening the screw and pushing the upper support rod by hand to a higher elevation. To maintain the upper support rod at the higher elevation, the tightening screw is tightened. This umbrella design has several disadvantages. For example, it can only be raised and lowered by hand. As such, the height to which the canopy can be raised is limited by the height of the user. Additionally, the size and choice of materials for the umbrella are limited by the requirement that the assembly be light enough to be lifted by a user. Thus, this design inherently limits the range of possible applications and uses. Additionally, the block slides along the lower support rod and could damage or disfigure the outer surface thereof.

SUMMARY OF THE INVENTION

It is therefore an object of one embodiment of the invention to provide an umbrella that is more robust and more reliable and in which a canopy thereof can be operated independently of the elevation of the canopy.

In one embodiment, an umbrella assembly is provided that comprises a canopy frame, a support pole, an extension mechanism, and a canopy deployment mechanism. The support pole has a first member that has a first end and a second end and a second member. The second member has a first end and a second end. The second member is coupled with the canopy frame. The second member is coupled with the first member and is movable relative to the first member between a retracted position and an extended position. The extension mechanism is coupled with the support pole and is configured to be driven by a crank handle to move the second member between the retracted position and the extended position. The canopy deployment mechanism is coupled with the support pole and is configured to be driven by a crank handle independently of the extension mechanism to open and close the canopy frame.

In another embodiment, an umbrella assembly is provided that comprises a support pole and a canopy frame. The support pole has a first member and a second member. The canopy frame is coupled with the second member. The first member has an outer surface and an inner surface that at least partially surrounds a space. The second member at least partially extends within the space. The umbrella assembly also includes a driven member that is coupled with the second member and that faces the inner surface of the first member. The umbrella assembly also includes a drive member configured to apply a force to the driven member in response to rotation of a crank handle whereby the second member can be moved relative to the first member.

In another embodiment, an umbrella is provided that comprises a canopy frame, a support pole, a canopy deployment mechanism and an extension mechanism. The support pole has a curved pole portion and a first pole portion. The curved pole portion has an upper end coupled with the canopy and a lower end. The first pole portion has a lower end, an upper end, and a longitudinal axis. The first pole portion defines a passage through which the curved pole portion can be moved generally transversely to the longitudinal axis of the first pole portion. The extension mechanism is coupled with the support pole and is configured to be driven by a crank handle to move the curved pole portion between a retracted position and an extended position. The canopy deployment mechanism is coupled with the support pole and configured to be driven by a crank handle independently of the extension mechanism to open and close the canopy frame. The lower end of the curved pole portion is located outside the first pole portion when the curved pole is in the retracted position.

In another embodiment, an umbrella is provided that includes a base, a canopy, and a support pole. The canopy has a canopy frame and a canopy fabric. The support pole has an upright pole, a curved pole, and an extension mechanism housing. The upright pole has a lower end coupled with the base, an upper end, and a longitudinal axis. The curved pole has an upper end coupled with the canopy and a lower end. The curved pole defines an enclosed space therein. The extension mechanism housing is located at the upper end of the upright pole. The extension mechanism defines a passage through which the curved pole can be moved generally transversely to the longitudinal axis of the upright pole. The umbrella also includes an extension mechanism and a canopy deployment mechanism. The extension mechanism is at least partially housed within the extension mechanism housing. The extension mechanism includes a pinion gear and a rack. The pinion gear is mounted in the extension mechanism housing to rotate about an axis extending generally transversely to the longitudinal axis of the upright pole. The rack is coupled with the curved pole and configured to be driven by the pinion gear. Rotation of the pinion gear is converted to translation of the curved pole within the passage. The canopy deployment mechanism is coupled with the support pole adjacent the lower end of the curved pole. The canopy deployment mechanism has a drum mounted in the enclosed space of the curved pole and a tension member. The tension member has a lower end coupled with the drum and an upper end coupled with the canopy frame. The umbrella also includes a crank configured to engage the extension mechanism and the canopy deployment mechanism. The extension mechanism is configured to move the curved pole between a retracted position and an extended position. The lower end of the curved pole is located outside the extension mechanism housing when the curved pole is in the retracted position.

BRIEF DESCRIPTION OF THE DRAWINGS

Some preferred embodiments of the invention will now be more particularly described by reference to the accompanying drawings, in which.

DETAILED DESCRIPTION OF THE PREFERRED EMBODIMENT

Figures 1, 1A, 1B:
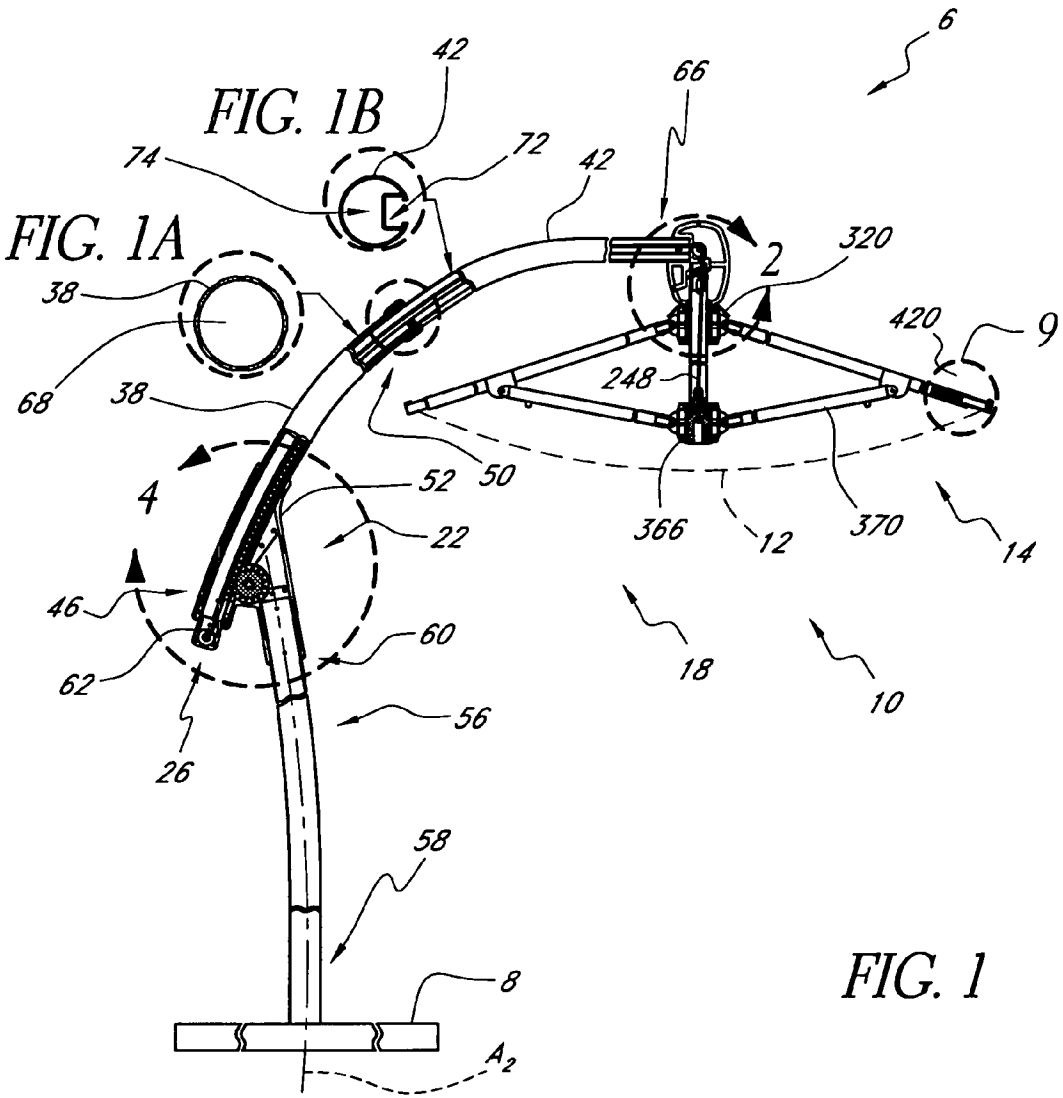
FIG. 1 is a plan view of one embodiment of an umbrella assembly shown in an extended position.
FIG. 1A is a cross-section view of a portion of a support pole of the umbrella at the location indicated in FIG. 1.
FIG. 1B is a cross-section view of another portion of the support pole of the umbrella at the location indicated in FIG. 1.
Figure 2:
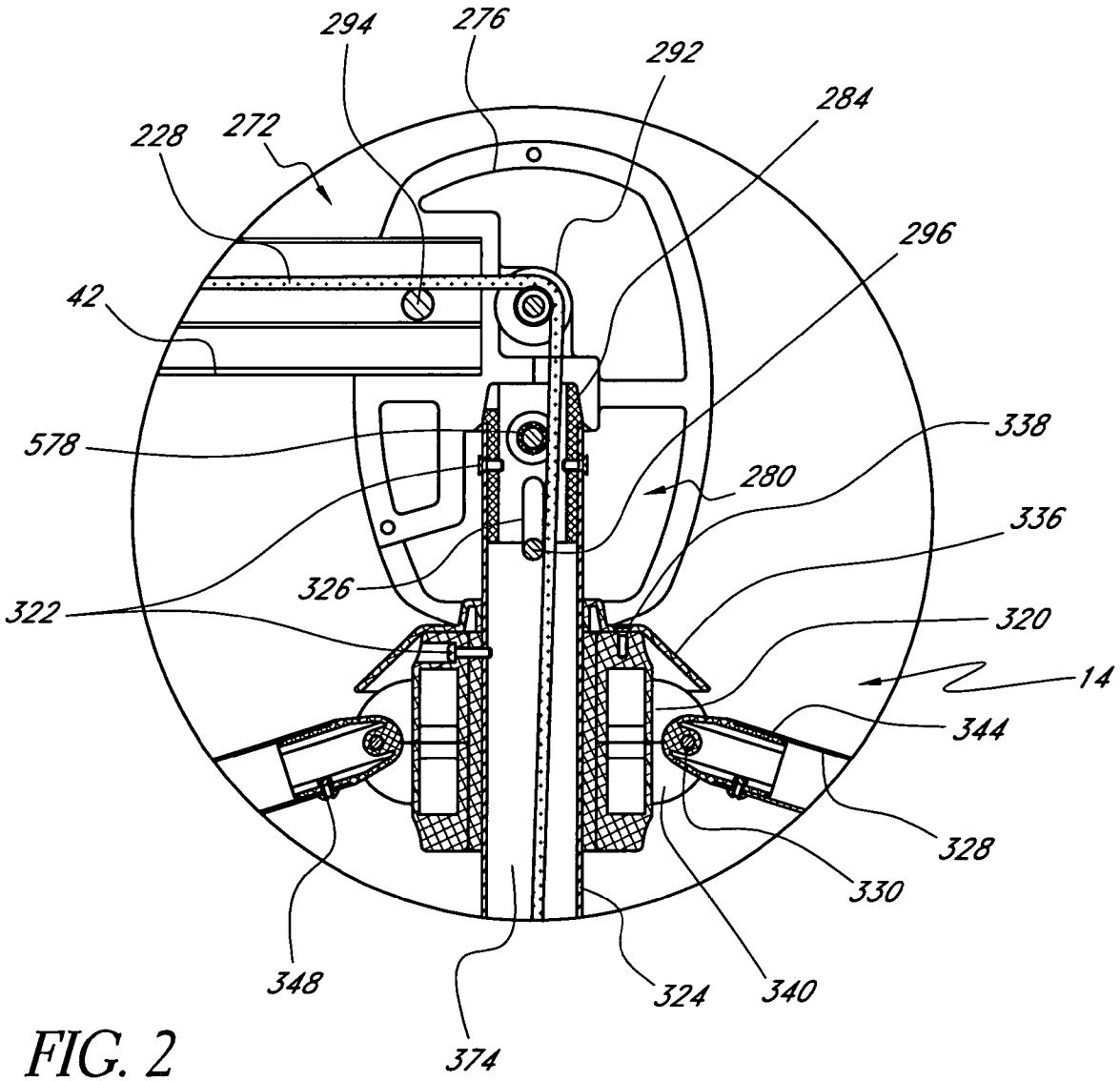
FIG. 2 is a cross-section view of a portion of the embodiment of FIG. 1 taken at the section 2—2, illustrating the umbrella assembly in an open position.
Figure 3:
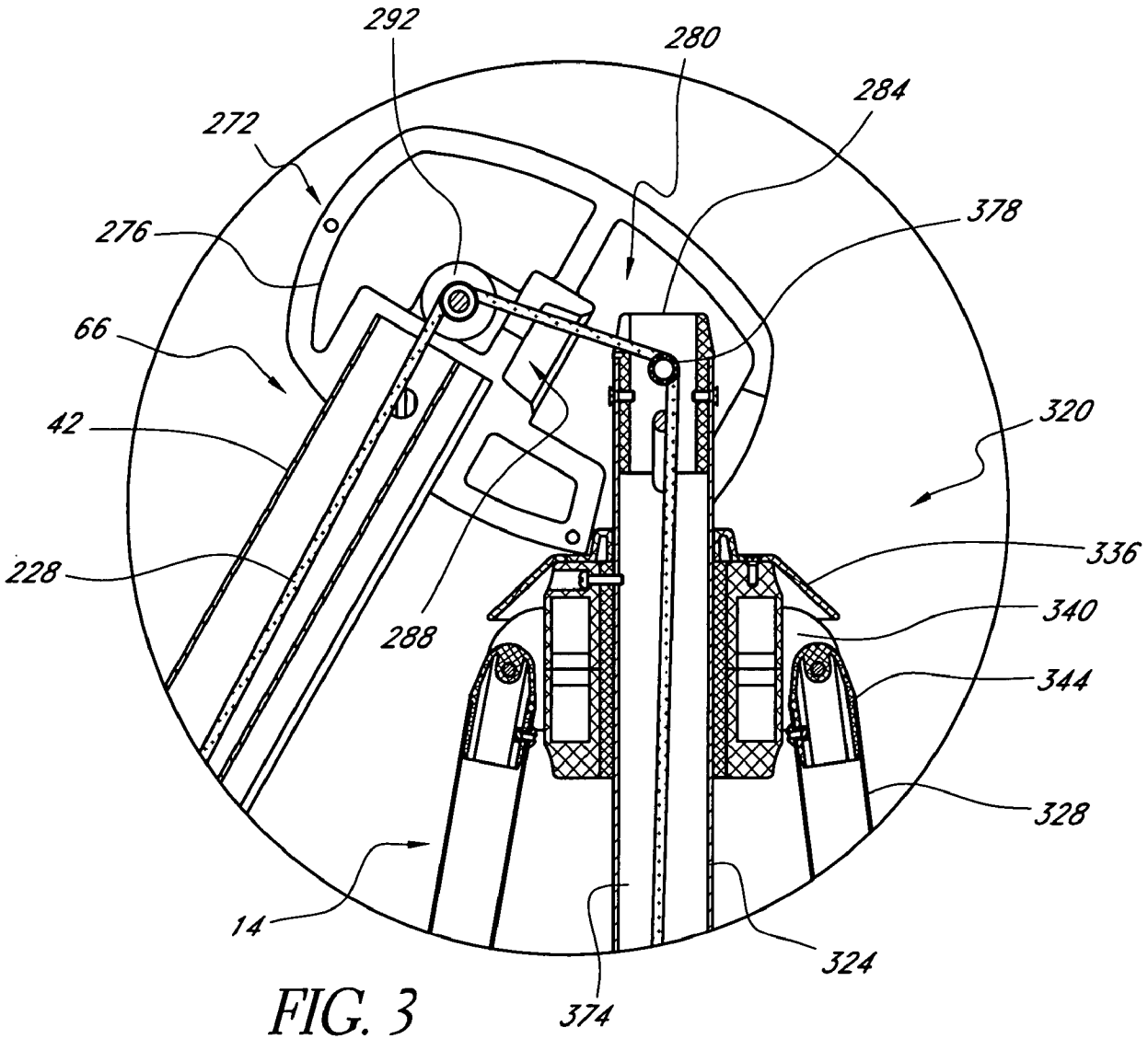
FIG. 3 is a cross-section view similar to that of FIG. 2, illustrating the canopy frame in a closed position.

This application is directed to umbrellas and umbrella assemblies with a support pole having at least two members that are movable relative to each other to position a canopy in one or more extended positions and in one or more retracted positions. In various embodiments, discussed below in connection with FIGS. 1–9, the support pole includes a first member, which may be a fixed pole, and a second member, which may be a curved pole coupled with a canopy frame. The second member moves relative to the first member. In other embodiments, discussed below in connection with FIGS. 10–15, a second curved member moves within a first member and is substantially housed within the first member when the umbrella or the canopy is in a retracted position. As used in this context "substantially housed" means that about half or more of the length of the second member is housed within the first member. In some embodiments, movement of a second member of a support pole relative to a first member of the support pole is achieved by driving a driven member coupled with an outer surface of the second member, as discussed further below.

FIGS. 1–9 illustrate various embodiment of an umbrella 6 that includes a base 8, an umbrella assembly 10, and a canopy fabric 12. The canopy fabric 12 is shown schematically in FIG. 1 as a dashed line. The applicant contemplates that the canopy fabric 12, the base 8, and or other components of the umbrella 6 can be customized to the tastes or needs of the consumer. Thus, the umbrella assembly 10 can be made and sold separately from these components. Accordingly, this application is directed to relevant subassemblies of the umbrella 6 and the other umbrellas described herein.

The umbrella assembly 10 preferably includes a canopy frame 14, a support pole 18, an extension mechanism 22, and a canopy deployment mechanism 26. The term "canopy" is used in connection with some embodiments to include the canopy frame 14, the canopy fabric 12, and other related components. The canopy fabric 12 can be made of a natural or synthetic cloth or any other structure that can be overlaid of stretched over the canopy frame 14 to provide shelter, as discussed below.

In one embodiment, the support pole 18 has a first member 38 and a second member 42. The first and second members 38, 42 are elongate members in some embodiments. The first member 38 has a first end 46 and a second end 50. As discussed further below, in various embodiments, the first member 38 is coupled with or is formed to include other structures. For example, in one embodiment, an extension mechanism housing 52 is coupled with the first member 38. The extension mechanism housing 52 can enclose at least some of the components of the extension mechanism 22 to shroud these components, providing protection for these components and preventing objects from becoming lodged therein.

The first member 38 can also be coupled with, formed to include, or can comprise a substantially vertical portion 56. In one embodiment, the substantially vertical portion 56 is configured to be coupled with the base 8 at a first end 58 and with the extension mechanism housing 52 at the second end 60. The substantially vertical portion 56 can be elongated, extending along a longitudinal axis between the first and second ends 58, 60. In one embodiment, the umbrella 6 rests on or is mounted to a horizontal surface, such as the ground, a patio, or a deck or other stable structure. The substantially vertical portion 56 can be configured as an upright pole portion. In some applications, the umbrella 6 can be mounted to a vertical surface and the substantially vertical portion 56 can be configured to extend outwardly from the vertical surface.

The first member 38 preferably comprises a tubular portion with a passage through which the second member 42 travels between extended and retracted positions. In one embodiment, the extension mechanism housing 52 comprises a tubular portion. Travel of the second member 42 relative to the first member 38 or the extension mechanism housing 52 can be facilitated by bearing structures, which are discussed below in connection with FIGS. 7 and 8. In one embodiment, the extension mechanism housing 52 is located adjacent to the second end 60 of the substantially vertical portion 56. The extension mechanism housing 52 also can be located adjacent to the first end 46 of the first member 38. The extension mechanism 22 can be located adjacent to the second end 60 of the substantially vertical portion 56, the first end 46 of the first member, or at any other convenient position on the umbrella 6.

The second member 42 has a first end 62 and a second end 66. The second member 42 preferably is coupled with the canopy frame 14, e.g., at the second end 66. Any suitable connection can be provided. As discussed below in connection with FIGS. 2 and 3, one preferred connection between the second member 42 and the canopy frame 14 is a pivot or hinge-type connection.

The second member 42 is coupled with the first member 38 and is movable relative to the first member 38. In particular, the second member 42 preferably is movable between retracted positions and extended positions. An extended position is illustrated in part in FIGS. 1 and 2. A retracted position is illustrated in part in FIG. 3.

Figure 4:
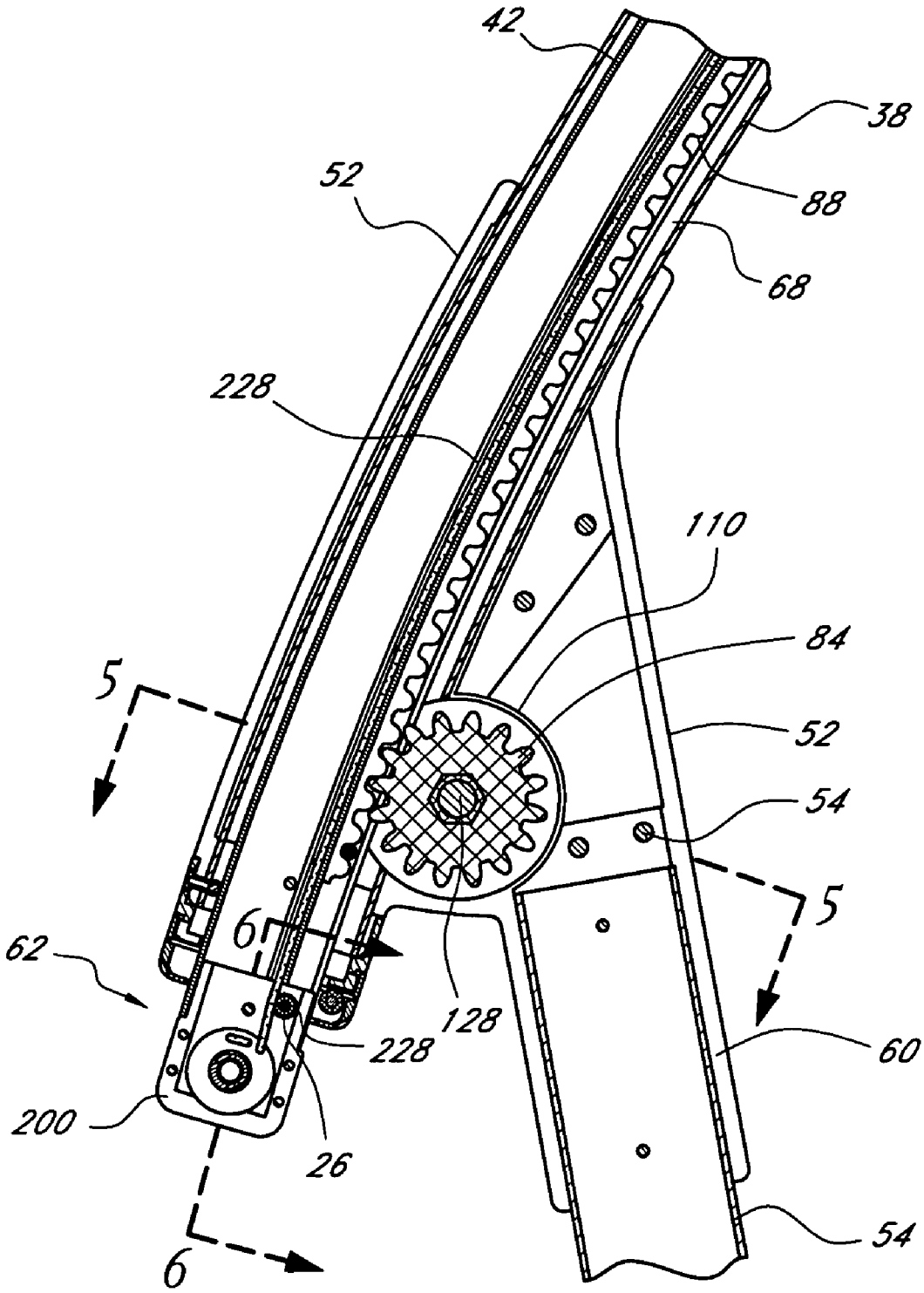
FIG. 4 is a cross-sectional view of a portion of one embodiment of an extension mechanism of the umbrella assembly of FIG. 1 taken at the section 4—4.

The first member 38 comprises a curved pole in one embodiment that encloses a passage 68. The passage 68 is shown in FIG. 4. The second member 42 can comprise a curved pole, which is able to be received in the passage 68. In some embodiments, a wall of the first member 38 surrounds the passage 68. In other embodiments, the first member 38 at least partially surrounds a space within which the second member 42 extends and can travel.

Figure 5:
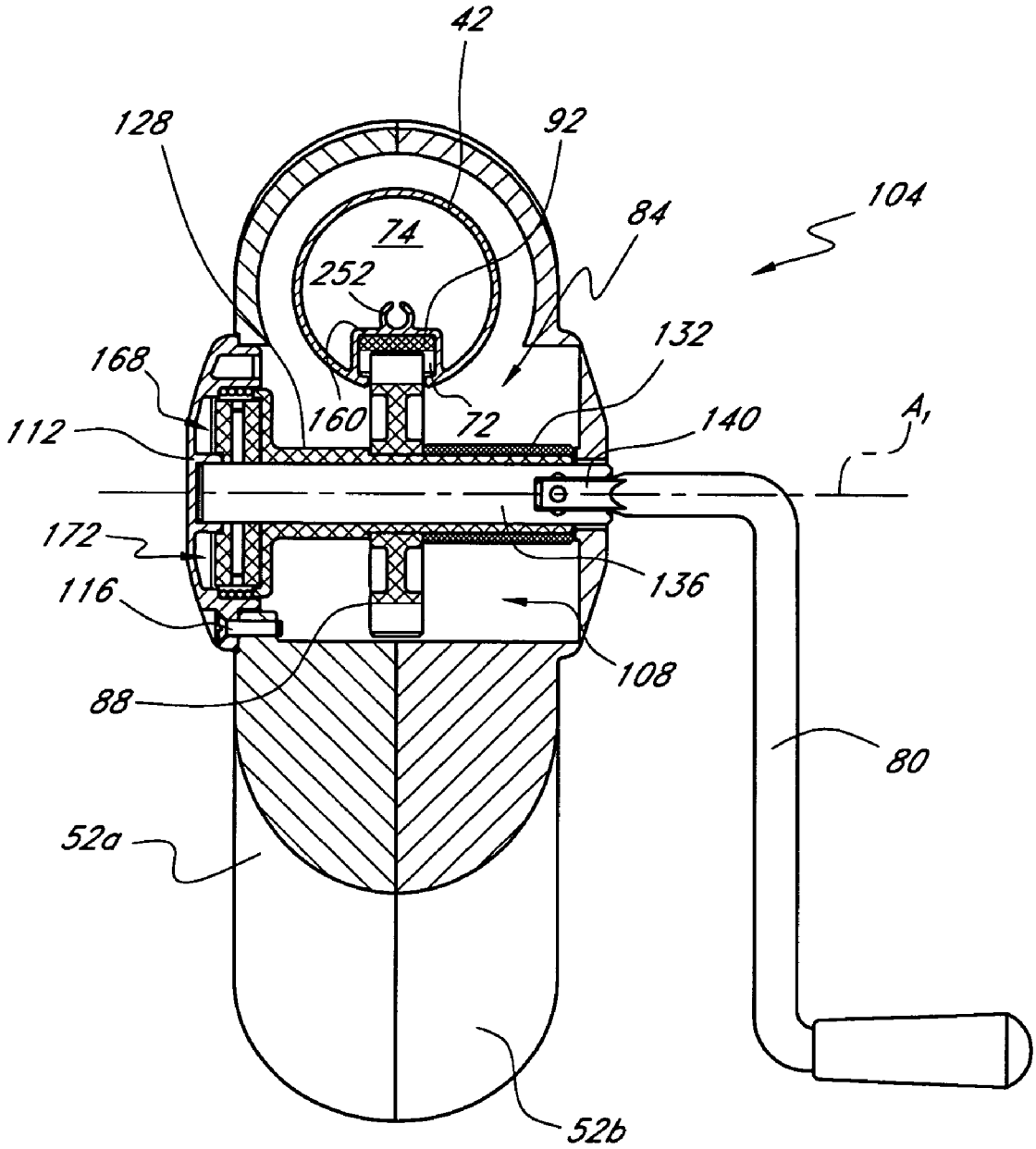
FIG. 5 is a partial cross-section view of the extension mechanism of FIG. 4 taken at the section 5—5.

The second member 42 is a semi-cylindrical curved pole in one embodiment that has a recess 72 formed therein. The recess 72, which is shown in FIGS. 1B and 5, can be configured to house at least a portion of the extension mechanism 22, as discussed further below. The recess 72 also can act as a guide track for a bearing structure or a guide member, as discussed further below. The second member 42 preferably also defines an enclosed space 74 that extends between the first and second ends 62, 66. As discussed below, the space 74 is convenient for housing one or more components of the canopy deployment mechanism 26.

In one embodiment, the second member 42 has a length between the first and second ends 62, 66 that is greater than a length of the first member 38 between the first and second ends 46, 50. In this arrangement, the first end 62 remains outside the passage 68 formed in the first member 42 in at least one of an extended position and a retracted position. In one embodiment, the first end 62 remains outside the passage 68 both in an extended position and in a retracted position. As discussed further below, an end of a movable member remains inside a passage of a fixed member when the movable member or the umbrella is in the retracted position in some of the embodiments of the umbrella of FIGS. 10–15.

With reference to FIGS. 4 and 5, various embodiments of the extension mechanism will be discussed. The extension mechanism 22 can take any suitable form and can be coupled with the support pole 18 at any convenient location, e.g., at the extension mechanism housing 52. In one arrangement, the extension mechanism housing 52 includes a first portion 52*a* and a second portion 52*b* that are coupled together with one or more suitable fasteners, e.g., screws 54. This arrangement is advantageous in that the extension mechanism housing 52 can be disassembled quickly so that the extension mechanism 22 can be serviced.

In one embodiment, shown in FIG. 5, the extension mechanism 22 includes a crank handle 80, a shaft assembly 84, a drive member 88, and a driven member 92. As discussed below, the drive member 88 can be coupled with the shaft assembly 84.

The shaft assembly 84 can be mounted to the support pole 18 in any suitable manner. In one arrangement, the umbrella 6 is provided with a shaft mounting portion 104. In one embodiment, the extension mechanism housing 52 is provided with a shaft mounting portion 104. The shaft mounting portion 104 includes a shaft passage 108 extending generally transverse to the extension mechanism housing 52, e.g., between an external surface of the first and second portions 52*a*, 52*b* thereof. The shaft passage 108 preferably is at least partially enclosed by a wall 110. The wall 110 can have a shape corresponding to the drive member 84 or another component of the extension mechanism 22. In one arrangement, the shaft passage 108 is accessible at a first end by removing a cover member 112. The cover member 112 is a plate in one embodiment. In one arrangement, the cover member 112 is configured to be coupled with the extension mechanism housing 52 by one or more screws 116. The shaft passage 108 can be accessible at a second end through a small hole in the second portion 52*b* of the extension mechanism housing 52.

The shaft assembly 84 can take any suitable form. In one embodiment, the shaft assembly 84 includes a shaft 128 (shown in FIG. 4) that extends through the passage 108. The shaft preferably is journaled for rotation within the extension mechanism housing 52. For example, one ore more bearings can be coupled with the extension mechanism housing 52 and with the shaft 128 to facilitate rotation of the shaft. The shaft 128 is configured to rotate about an axis A1. The axis A1 also is generally transverse to the extension mechanism housing 52. The axis A1 extends generally transversely to the longitudinal axis A2 of the substantially vertical portion 56 in one embodiment.

Preferably the shaft 128 is configured such that the drive member 88 can be mounted thereon. In one arrangement, the shaft 128 is stepped so that the shaft has at least two diameters along its length. This arrangement provides at least one shoulder against which a portion of the drive member 88 (e.g., a side surface thereof) can be positioned. In one arrangement, the shaft assembly 84 also includes a sleeve 132 configured to slide over a portion of the shaft 128. The sleeve 132 is configured to be positioned adjacent another portion of the drive member 88 (e.g., another side surface thereof). In one arrangement, a shoulder of the shaft 128 and the sleeve 132 cooperate to maintain the drive member 88 in a relatively fixed position along the length of the shaft 132. In one embodiment, the sleeve 132 is configured to extend from a side surface of the drive member 88 to an internal wall of the second portion 52*b* of the extension mechanism housing 52. In this arrangement very little space is provided between the internal wall of the second portion 52*b* and the sleeve 132 and between the sleeve 132 and the drive member 88. By limiting the space between these components, axial movement of the drive member 88 along the shaft 128 toward the second portion 52*b* is limited.

The arrangement of the extension mechanism 22 is advantageous in that it enables the drive member 88 to be quickly and easily accessed and disassembled from the shaft assembly 84 for service or repair. Also, portions of the shaft assembly 84 can be relatively easily disassembled and serviced in this arrangement. The shaft assembly 84 can be modified in other embodiments. For example, the drive member 88 could be interference fit to the shaft 128.

The shaft 128 preferably also has a crank engagement portion 136, which may be a recess formed to receive an end of the crank handle 80. For example, the end of the crank handle 80 and the recess 136 can each have a matching shape such that when the crank handle 80 is inserted into the crank engagement portion 136, a force can be transmitted therebetween. In one arrangement, both the crank engagement portion 136 and an end of the crank handle 80 have a similar shape and the size of the crank engagement portion 136 is somewhat larger than that of the crank handle 80. In one embodiment, the crank engagement portion 136 and the end of the crank 80 configured to engage the crank engagement portion 136 is are rectangular in shape. In these embodiments, an end of the crank handle 80 can be inserted into the crank engagement portion 136 such that rotation of the crank handle 80 causes the shaft 128 and the drive member 88 to rotate.

Other arrangements can facilitate engagement of the crank handle 80 and the shaft assembly 84. For example, spring-loaded members 140 can be mounted on the crank handle 80 and corresponding recesses can be formed within the crank engagement portion 136, e.g., in a detent arrangement.

The drive member 84 can take any suitable configuration. In one arrangement, the drive member 84 is a gear. However, any arrangement can be provided whereby the drive member 84 is configured to transmit a force to the second member 42. As discussed below, a rack-and-pinion gear arrangement is preferred for some configurations. The drive member 84 can be a pinion gear having a plurality of gear teeth.

The driven member 88 preferably is coupled with the second member 42. As discussed above, the second member 42 can be a curved pole. In one embodiment, the driven member 88 is coupled with an outer surface 160 of the second member 42. As used in this context, the term "outer surface" is a broad term, including surfaces of the second member 42 that are not fully enclosed prior to the assembly of the support pole 18. The term "outer surface" also can include surfaces that may be at least partially housed within other components of the umbrella 6, such as the extension mechanism housing 52. See FIG. 5. The driven member 88 is configured to engage the drive member 84 and to be driven thereby upon rotation of the drive member 84. As discussed above, the drive member 84 may be rotated by the crank handle 80.

The driven member 88 may take any suitable form. Preferably the driven member 88 is a gear-type structure, for example a gear rack. In this context "gear rack" is a broad term that includes rigid and somewhat flexible structures with a surface or a series of regularly positioned surfaces capable of engaging the drive member 84. The term "gear rack" includes a rigid gear rack, a flexible belt with a plurality of teeth or ridges, and other similar structures. An advantage of the belt-type gear rack is that it can more easily conform to a curved profile of the second member 42 where provided.

In one embodiment, the driven member 88 is configured to be driven by the drive member 84. For example, as discussed above, the crank handle 80 is coupled with the crank engagement portion 136 and rotated. This rotation of the crank handle 80 causes the drive member 88 to rotate. Because the drive and driven members 84, 88 are engaged, a force can be transmitted therebetween. Such a force can be transmitted from the driven member 88 to the second member 42. The rotation of the drive member 84 (which can be caused by rotation of the crank handle 80) is converted to translation of the second member 42 within the extension mechanism housing 52. The second member 42 also can translate within the passage 68.

In some embodiments, a brake system 168 is provided that limits or prevents movement of the second member 42 relative to the first member 38, e.g., after the second member 42 has been moved to an extended position. The brake system 168 can take any suitable form. In one embodiment, the brake system 168 includes a resilient member 170, which can be a coil spring. The resilient member 170 can be positioned inside the shaft passage 108, e.g., in a recess 172 formed on an inside surface of the cover member 112. In one embodiment, the resilient member 170 has a first end 174*a* and a second end 174*b*. As discussed further below, the first and second ends 174*a*, 174*b* are configured to be engaged by another member to compress the resilient member 170. In particular, as discussed below, a force is applied to the first and second ends 174*a*, 174*b* to compress the member 170. In one embodiment, the brake system 168 is arranged such that when the resilient member 170 is not compressed by a force applied to the first and second ends 174*a*, 174*b*, the resilient member frictionally engages a surface 176 defined in the recess 172. The frictional engagement is such that relative movement between the drive and driven members 88, 92 and between the first and second members 38, 42 is prevented. In this sense, the cover member 112 or the surface 176 acts as a brake drum and the resilient member 170 acts as a brake shoe.

Figure 5A:
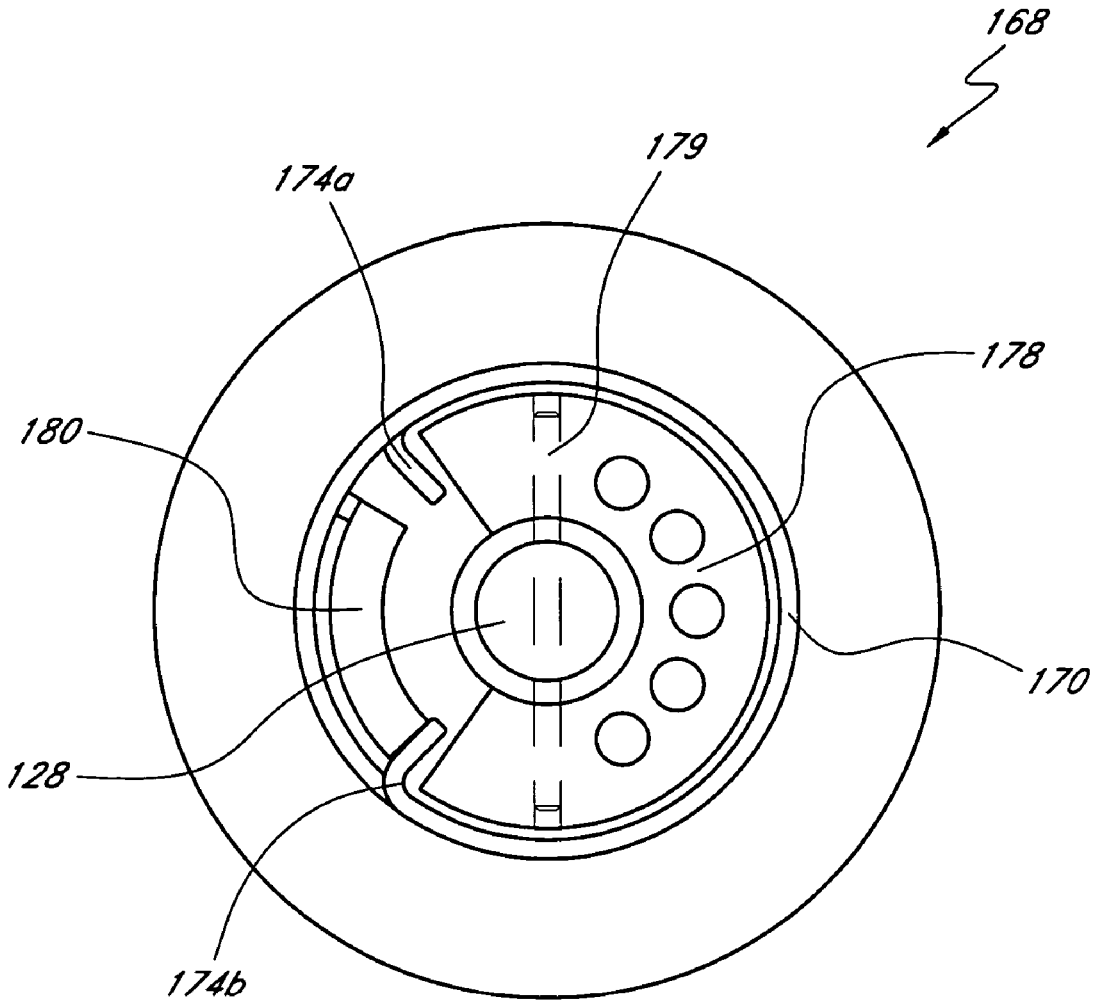
FIG. 5A is an end view of one embodiment of a brake system of the umbrella assembly of FIG. 1.

With further reference to FIG. 5A, the brake system 168 also includes a first brake engagement member 178 coupled with the shaft 128. The first brake engagement member 178 is configured such that when the brake system 168 is assembled, the brake engagement member is positioned adjacent to the ends 174*a*, 174*b*. In one arrangement, the first brake engagement member 178 comprises an arc that subtends an angle of more than 180 degrees, e.g., about 270 degrees, or more. The first brake engagement member 178 can be coupled with the shaft 128 in any suitable fashion. In one arrangement a thru-hole is formed in the first brake engagement portion 178 and a recess or thru-hole is formed in the shaft 128 such that a pin 179 can be inserted through the first brake engagement portion 178 and into the shaft 128 to couple the first brake engagement portion 178 with the shaft 128.

In one embodiment, the brake system 168 also includes a second brake engagement portion 180 that is coupled with the drive member 88. The second brake engagement portion 180 preferably extends axially and laterally of the drive member 88 into the recess 172 of the cover member 112. The second brake engagement portion 180 extends to a location adjacent to the first and second ends 174*a*, 174*b* of the resilient member 170.

In use, rotation of the crank handle 80 causes at least one of the first and second brake engagement portions 178, 180 to engage the resilient member 170. In the illustrated embodiment, small gaps are provided between adjacent edges of the first and second brake engagement portions 178, 180. These gaps are sized to receive the first and second ends 174*a*, 174*b* and are small enough that a relatively small rotation of the crank handle 80 (and the shaft 128) causes one of the brake engagement portions to engage one of the ends of the resilient member 170. Such engagement causes the resilient member 170 to be compressed. Compression of the resilient member 170 causes the member to be disengaged from the surface 176 of the recess 172. For example, compression of the resilient member 170 can reduce the force applied by the resilient member 170 to the surface 176. As the force is reduced, relative motion of the first and second members 38, 42 is no longer prevented and the drive member 88 can be rotated to move the driven member 92. This enables relative movement between the first and second members 38, 42 of the support pole 18.

Figure 6:
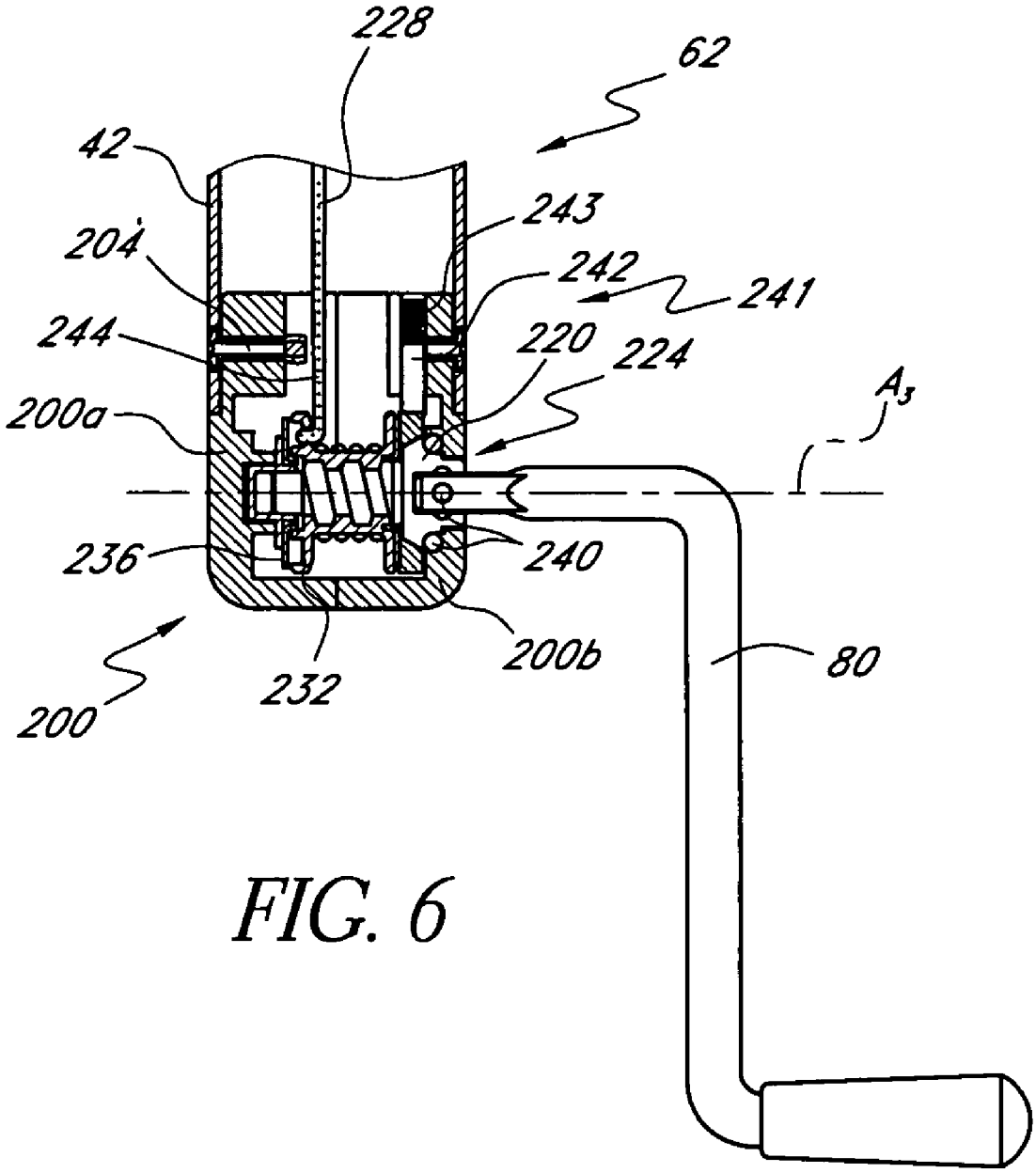
FIG. 6 is a partial cross-section view of one embodiment of a canopy deployment mechanism of the umbrella assembly of FIG. 1 taken at the section 6—6.

The canopy deployment mechanism 26 can be coupled with the support pole 18 in any convenient location. In one embodiment, a portion of the canopy deployment mechanism 26 is coupled with the second member 42 adjacent the first end 62. In one arrangement a deployment mechanism housing 200 is provided to house a portion of the canopy deployment mechanism 26. In one arrangement, the housing 200, as shown in FIG. 6, includes a first housing member 200*a* and a second housing member 200*b* that can be coupled together in a suitable fashion, e.g., using a suitable a fastener such as a screw. The deployment mechanism housing 200 can be connected to the first end 62 of the second member in any suitable manner, e.g., using rivets 204 or other suitable fasteners. In one embodiment, additional components of the canopy deployment mechanism 26 extend from the first end 62 of the second member 42 toward the canopy frame 14, as discussed further below.

The canopy deployment mechanism 26 can take any suitable form. In one embodiment, the canopy deployment mechanism 26 includes a drum 220 rotatably journaled on the support pole 18. In one embodiment, the drum 220 is journaled on the second member 42. In the embodiment illustrated in FIG. 6, the drum 220 is journaled in the deployment mechanism housing 200. The drum 220 preferably has a crank engagement portion 224 and is configured to have wound thereabout a tension member 228. In one arrangement, the drum 200 has a radially extending flange 232 and an outer cover 236 between which the tension member 228 can be connected to the drum 220. As discussed above in connection with the extension mechanism 22, a detent coupling 240 can be provided in connection with the crank engagement portion 224.

The crank engagement portions 136 and 224 are separate. This is advantageous in that such separate placement enables the canopy deployment mechanism and the extension mechanisms to be operated separately. This allows the canopy to be opened fully and extended only as much as needed. The crank engagement portions 136 and 224 preferably are configured such that a single crank handle can be used to operate both mechanisms.

As discussed further below, winding the tension member 228 on the drum 220 can be facilitated by a ratchet device 241. In one embodiment, the ratchet device 241 includes a rigid member 242 that is configured to engage any of a plurality of surfaces rigidly coupled with the drum 220. In one arrangement, the rigid member 242 is biased into engagement with the ratchet surfaces by a resilient member 243. The resilient member 243 can be a coil spring. The ratchet device 241 is configured to have a first mode wherein rotation of the drum 220 is allowed only in a first direction. In the first mode, the tension member 228 can be wound about the drum 220 as the drum is rotated in the first direction. The tension member 228 will not become inadvertently unwound from the drum 220 because the first mode substantially prevents rotation in a direction opposite the first direction.

The ratchet device 241 is configured to have a second mode wherein rotation of the drum 220 is allowed in a second direction so that, for example, the tension member 228 can be un-wound from the drum 220. In the second mode, the ratchet device 241 can be said to be disengaged from the drum 220 or from the canopy deployment mechanism 26. In one embodiment, the ratchet device 241 may be disengaged by translating the drum 220 along an axis A3 that extends through the center of the drum 220, e.g., toward the left in FIG. 6. When slid all the way to the left, the rigid member 242 will not engage a surface of the drum 220 and thus will not prevent rotation thereof in the second direction. The second direction may be opposite the first direction.

The tension member 228 has a first end 244 coupled with the drum 220. In one embodiment, a second end 248 of the tension member 228 is coupled with the canopy frame 14, as discussed further below. Between the first and second ends 244, 248, the tension member 228 extends along the support pole 18. In one embodiment, the tension member 228 extends within the second member 42, e.g., in the enclosed space 74. In some embodiments, one or more guide members 252 are provided within the enclosed space 74. The tension member 228 slides within the guide member 252, which can be fixed to an internal surface of the second member 42. The guide members 252 can be provided with reduced friction surfaces to ease the operation of the tension member 228. The guide members 252 also cause the tension member 228 to operate at a predetermined location within the second member 42.

As discussed above, a pivot or hinge portion 272 (FIGS. 2 and 3) is provided between the second member 42 and the canopy frame 14 in some embodiments. This arrangement enables the umbrella 6 to be retracted to a compact arrangement. The hinge portion 272 includes a hinge housing 276 adjacent to the second end 66 of the second member 42. In one embodiment, the hinge housing 276 is mounted on the second end 66 of the second member 42. The hinge housing 276 has a chamber 280 in which an upper portion 284 of the canopy frame 14 can move. A recess 288 is defined by walls within the hinge housing 276 to receive the upper portion 284, as discussed further below.

In one embodiment, the hinge housing 276 includes a rolling guide portion 292 over which the tension member 228 extends. The rolling guide portion 292 can be a pulley. In some embodiments, a guide member 294 is provided in the second member 42 near the second end 66 to align the tension member 228 with the rolling guide portion 292. The hinge housing 276 also includes a coupler 296 that engages the upper potion 284. In one embodiment, the coupler 296 is rigidly connected to the hinge housing 276 and is configured to support the canopy frame 14 and canopy fabric 12 when the canopy is closed. See FIG. 3.

The canopy frame 14 includes an upper central housing 320 through which a central vertical member 324 extends. The central vertical member 324 includes a slot 326 into which the coupler 296 can extend. The central vertical member 324 is able to move within the hinge housing 276 along the slot 326. When the upper end of the slot 326 contacts the coupler 296 (as in FIG. 3), the canopy frame 14 is supported by the coupler 296. In one embodiment, the coupler 296 moves to a lower end of the slot 326 when the canopy frame 14 is opened, as discussed further below.

A plurality of ribs 328 can be coupled with the upper central housing 320 at upper ends 332 thereof. The upper central housing 320 is coupled with the central vertical member 324 by a suitable fastener, such as a screw 322. The ribs 328 preferably are pivotably connected to the upper central housing 320 at a joint 330. A lower end portion 332 of at least one of the ribs 328 can be biased to improve the connection of the canopy fabric 12 to the canopy frame 14.

The upper central housing 320 includes a cap member 336 that is configured to engage or be positioned adjacent to the hinge housing 276. The cap member 336 may be coupled with the upper central housing 320 in any suitable manner, e.g., by a fastener such as a screw 338. The upper central housing 320 also includes a plurality of flanges 340 to which the ribs 328 may be attached. In one arrangement, a cover member 344 is attached to the upper end of the ribs 328 by a rivet 348.

The canopy frame 14 also includes a lower central housing 366 and a plurality of struts 370 that extend between the lower central housing 366 and the ribs 328 to provide additional structural support for the ribs. The struts 370 are pivotably connected in a suitable manner at both ends with the lower central housing 366 and with the ribs 328.

The central vertical member 324 has a space 374 defined therein through which the tension member 228 may extend to the lower central housing 366. In one embodiment, a pulley 378 (or other rolling guide member) is mounted in the space 374 and is positioned such that the tension member 228 is guided thereover.

The canopy may be deployed using the crank handle 80. In particular, the crank handle 80 can be inserted into the crank engagement portion 224 of the canopy deployment mechanism 26. After the crank handle 80 is coupled or engaged with the drum 220, a force applied to the crank handle 80 can be transmitted through the drum 220 to the tension member. For example, the crank handle 80 can be rotated, which rotation is transferred to the drum 220. As the drum 220 rotates, the tension member 228 is wound onto the drum 220. As the tension member is wound onto the drum 220, a tension force is transmitted through the tension member 228 to the canopy frame 14. In particular, a force is transmitted through the tension member 228 to the lower central housing 366. This force is sufficient to cause the lower central housing 366 to move upward relative to the upper central housing 320. As the lower central housing 366 moves toward the upper central housing 320, the struts 370 transmit a force to the ribs 328. This force causes the ribs 328 to spread open to an open configuration. As the ribs 328 are opened the canopy fabric 12 is stretched thereover to provide shelter.

One advantage of the umbrella 6 and of the umbrellas described below is that they enable extension and retraction of, as well as opening and closing of, a canopy. In particular, the umbrella 6 is configured such that a single crank handle 80 can be used to extend and retract a canopy and to open and close the canopy. By providing a single crank handle 80, the number of components is reduced. Additionally, the crank handle 80 is separable from the rest of the umbrella 6. As such, the crank handle 80 can be removed from the umbrella 6 and stored out of the way. This makes the umbrella 6 more aesthetically pleasing, with fewer parts dangling therefrom.

Figure 8:
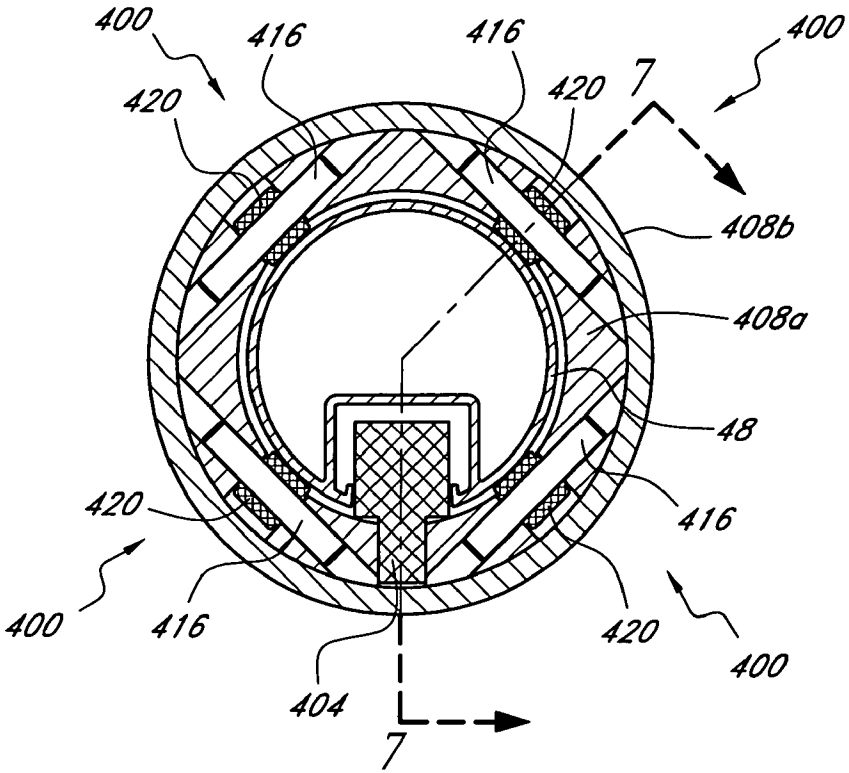
FIG. 8 is a partial cross-section of the extension mechanism of the umbrella assembly of FIG. 1 taken at the section 8—8.
Figure 7:
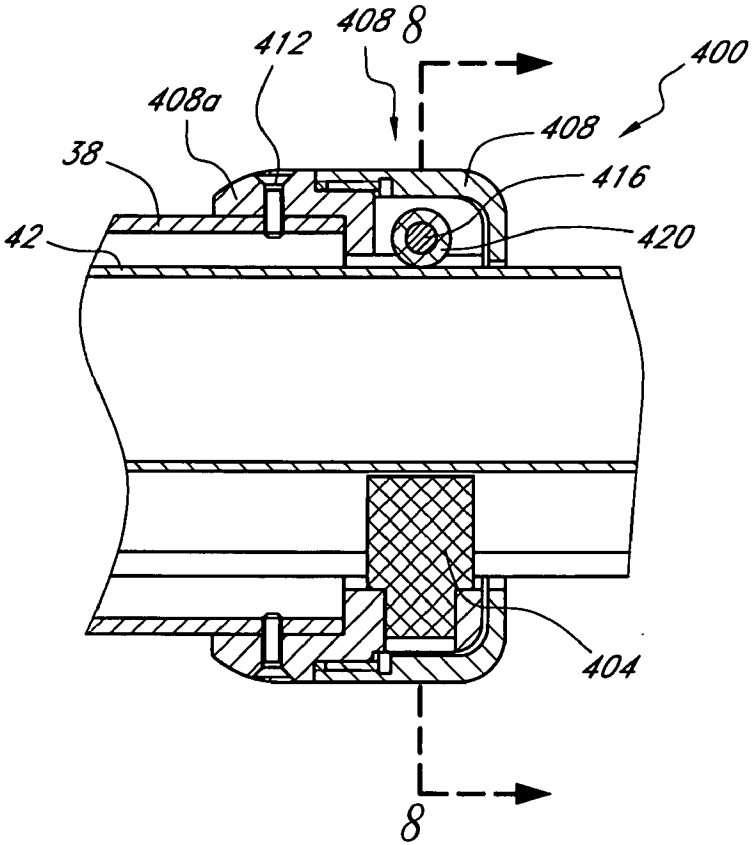
FIG. 7 is a partial cross-section view of a portion of the extension mechanism of the umbrella assembly of FIG. 1 taken at the section 7—7.

As discussed above, the crank handle 80 is engaged with the extension mechanism 22 and is rotated to cause the canopy frame 14 to be extended or retracted relative to a fixed portion of the umbrella 6, e.g., by moving the second member 42 relative to the first member 38. This movement may be facilitated in any suitable manner. FIGS. 7 and 8 illustrate that movement of the second member 42 relative to the first member 38 can be facilitated by providing at least one of a more guide member and a bearing. In one embodiment, a roller bearing 400 is provided that is configured to roll along a surface of the second member 42 as the second member is extended or retracted. In another embodiment, a fixed guide 404 member is provided that is configured to support a surface of the of the second member 42 as the second member is extended or retracted.

To make movement of the second member 42 easier (e.g., to reduce the torque needed at the axis A1), the roller bearing 400 and guide member 404 may be made of relatively low friction materials. In one embodiment, the guide member 404 is positioned to slide within the recess 72 formed on the outer surface of the second member 42. The recess 72 acts as a guide track for the guide member 404 in this embodiment. In one embodiment, a plurality of roller bearings 400 is provided. As illustrated in FIG. 8, one embodiment provides four roller bearings 400. The roller bearings 400 may be equally spaced about the second member 42.

The bearings 400 and guide member 404 may be mounted to the support pole 18 in any suitable manner. For example, a bearing housing 408 can be provided that is coupled to the first member 38 adjacent to the second end 50 thereof. The bearing housing 408 can take any suitable form. In one arrangement, the bearing housing includes a first portion 408*a* that is fixed to the second end 50 of the first member 38, e.g., by a screw 412, and a second portion 408*b* that is removably coupled with the first portion 408*a*. The second portion 408*b* can be removably coupled in any suitable manner, e.g., by including threads on an internal surface thereof that mate with external threads on the first portion 408*a*. In another arrangement, the first and second housing portions 408*a*, 408*b* are coupled together with a fastener (not shown).

FIG. 8 illustrates the construction of one bearing arrangement. The bearing 400 in one embodiment includes a shaft 416 that is mounted in the first housing portion 408*a*. A roller 420 is mounted on the shaft 416 and is configured to be able to rotate relative to the first housing portion 408*a*. An outer surface of the roller 420 contacts a surface of the second member 42. This arrangement reduced friction and enables the second member 42 to move relative to the first member 38 with comparatively less torque being applied by the crank handle 80.

Figure 9:
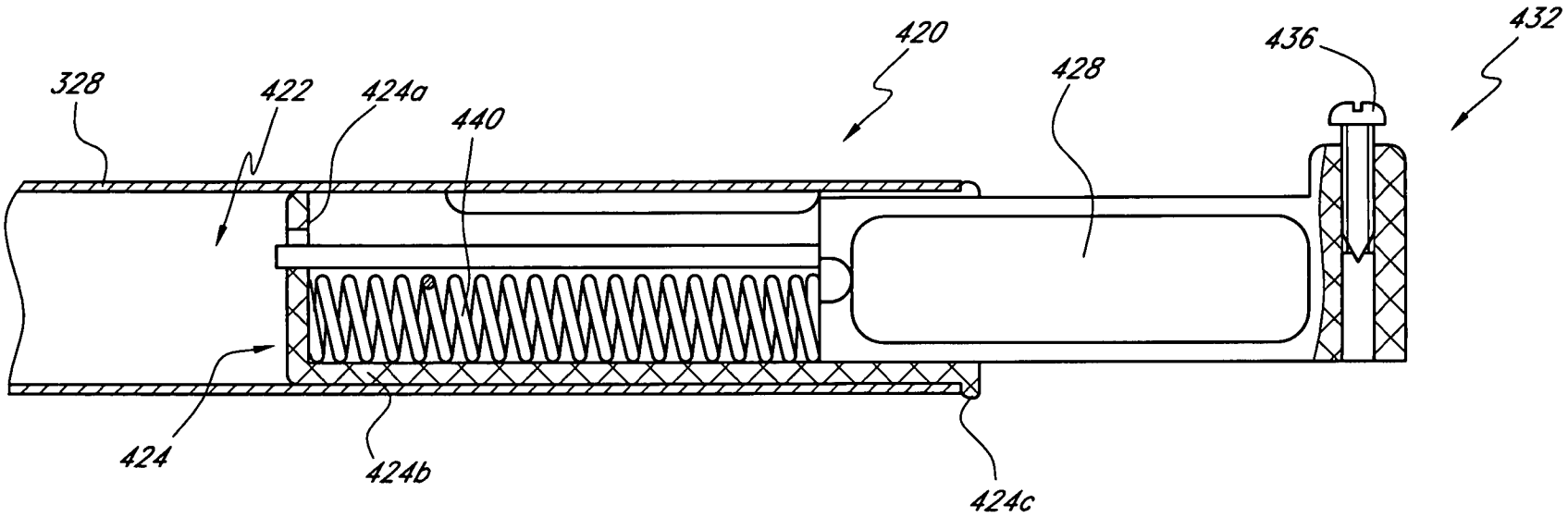
FIG. 9 is a cross-section of one embodiment of a portion of a canopy frame taken at the section 9—9.
Figures 10, 10A, 10B:
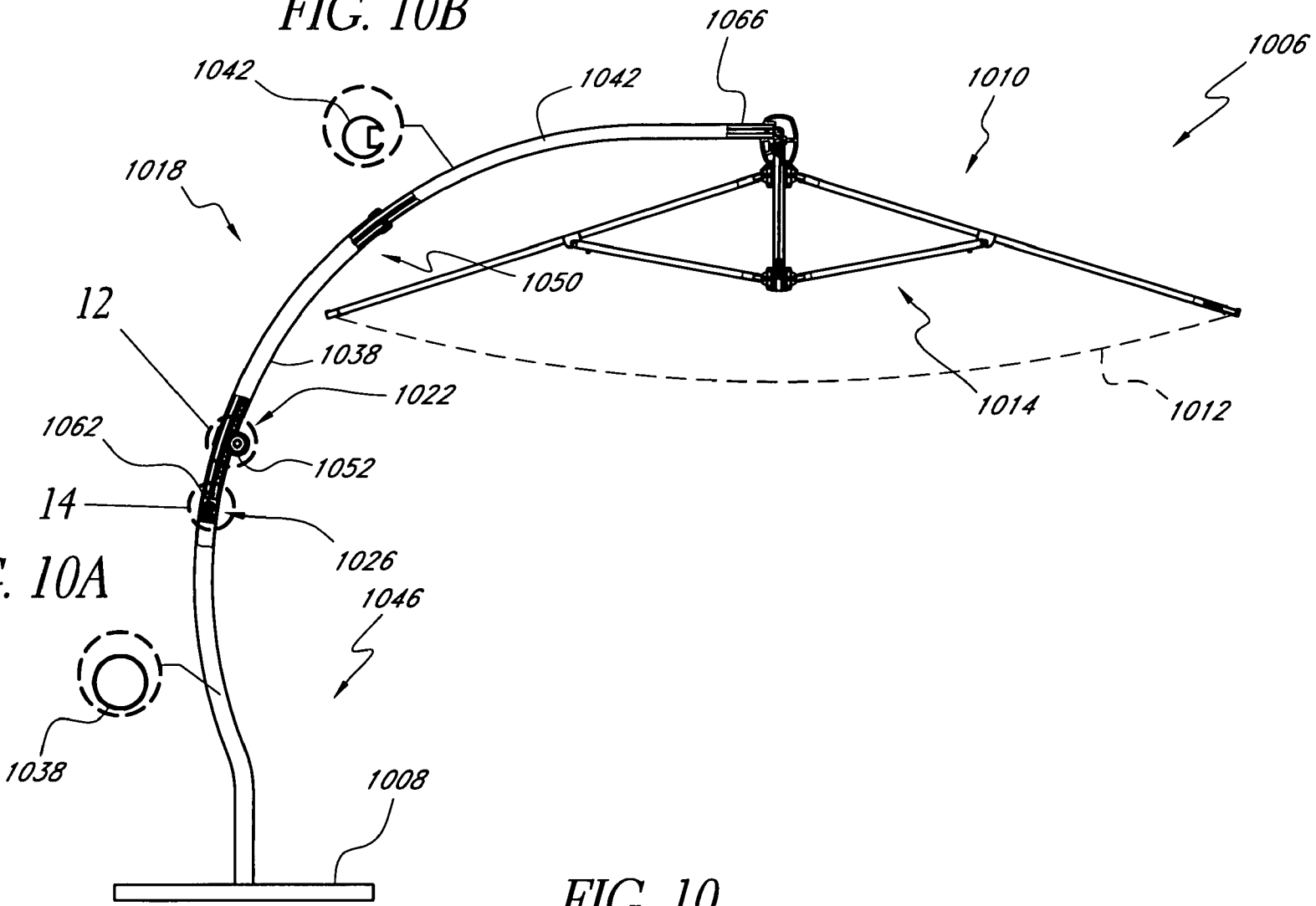
FIG. 10 is a plan view of another embodiment of an umbrella shown in an extended position.
FIG. 10A is a cross-section view of a portion of a support pole of the umbrella at the location indicated in FIG. 10.
FIG. 10B is a cross-section view of another portion of the support pole of the umbrella at the location indicated in FIG. 10.

FIG. 9 illustrates one arrangement of the umbrella rib 328 that is adjustable at a lower end 420. In the illustrated arrangement, the rib 328 defines a hollow portion 422 adjacent to the lower end 420. A flange 424 is mounted in the hollow portion 422 at a fixed position. The flange 424 can be reinforced by having a first portion 424*a* that extends transversely to a longitudinal axis of the rib 328 and a second portion 424*b* that extends parallel to the longitudinal axis of the rib 328 to the lower end thereof. In one embodiment, the flange 424 includes an enlarged ridge 424*c* that is larger than an opening at the end of the rib 328. This arrangement of the flange 424 is cup-shaped. The ridge 424*c* helps maintain the position of the flange 424. The flange 424 preferably is prevented from being pushed fully inside the rib 328. The flange 424 can be mounted in the rib 328 in any suitable manner, e.g., being press-fit or removably mounted, such as with fastener.

The rib 328 also includes a moveable member 428 that can move relative to the flange 424. Movement of the movable member 428 away from the first portion 424*a* of the flange 424 tends to elongate the rib 328. Movement of the movable member 428 toward from the first portion 424*a* of the flange 424 tends to shorten the rib 328. In one arrangement, one end 432 of the movable member 428 is configured to couple with a canopy fabric 12. For example, a fastener 436 can be coupled with the end 432 such that the canopy fabric 12 can be coupled therebetween.

In one embodiment, the rib 328 also includes a resilient member 440, which can be a coil spring, mounted between the flange 424 and the movable member 428. Where provided, the resilient member 440 advantageously biases the movable member 428 away from the first portion 424*a* of the flange 424. One benefit of this feature is that as the movable member 428 is biased away from the first portion 424*a*, a tension force can be applied to a canopy fabric 12 stretched over the canopy frame 14. Such tension force makes the canopy fabric 12 taught, which keeps it from sagging. This is particularly useful when the umbrella is deployed in rain.

FIGS. 10–16 illustrate other embodiments of an umbrella 1006 that is similar to the umbrella 6 except as described differently below. The umbrella 1006 includes a base 1008, an umbrella assembly 1010, and a canopy fabric 1012. The umbrella assembly 1010 can be made and sold separately from at least one component of the umbrella 1006, e.g., the base 1008 and/or the canopy fabric 1012. The umbrella assembly 1010 preferably includes the canopy frame 1014, a support pole 1018, an extension mechanism 1022, and a canopy deployment mechanism 1026.

In one embodiment, the support pole 1018 has a first member 1038 and a second member 1042. The first and second members 1038, 1042 are elongate members in some embodiments. The first member 1038 has a first end 1046 and a second end 1050. An extension mechanism housing 1052 can be coupled with, or can comprise an integral portion of, the first member 1038. The extension mechanism housing 1052 encloses at least some components of the extension mechanism 1022, shrouding this components as discussed above. In one embodiment, the first member 1038 comprises an arcuate or curved section that extends between the first and second ends 1046, 1050. The arcuate portion of the first member 1038 can be circular having a selected radius, or can be any other suitable arc or non-linear segment. In one embodiment, the first end 1046 of the first member 1038 includes a substantially vertical portion. See FIG. 10.

The first member 1038 includes a tubular portion with a passage through which the second member 1042 travels between extended and retracted positions.

The second member 1042 has a first end 1062 and a second end 1066. The second member 1042 includes an arcuate or curved section between the first and second ends 1062, 1066. The curved section is configured to match the curved section of the first member 1038, e.g., being circular and having a radius substantially identical to the radius of the curved section of the first member 1038. In one embodiment, the second end 1066 of the second member 1042 includes a substantially straight portion that extends generally horizontally of the curved portion of the second member 1042 when the canopy frame is in an extended position.

As discussed further below, the matching curved sections of the first and second members 1038, 1042 enabled the first end 1062 of the second member 1042 to be received within a passage defined within the first member 1038. Additionally, the matching curved portions of the first and second members 1038, 1042 enabled the second member 1042 to be retracted within the passage defined within the first member 1038 and to be extended from the passage defined within the first member 1038. The retraction and extension may be considered a "telescoping" motion or arrangement. These features are described further below.

Figure 11:
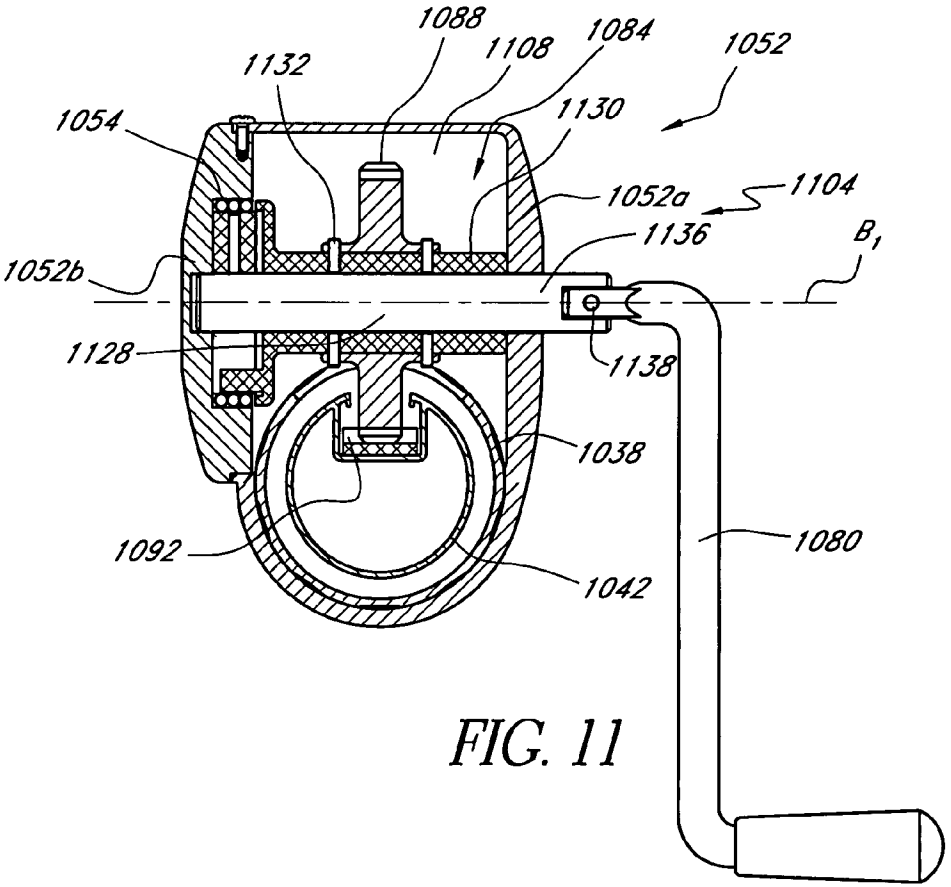
FIG. 11 is a cross-section view of an extension mechanism of one variation of the umbrella of FIG. 10.
Figure 12:
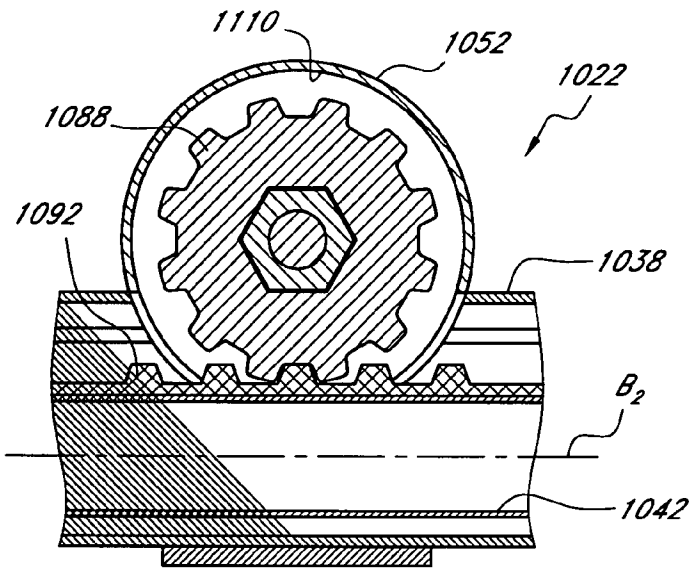
FIG. 12 is a cross-section view of the extension mechanism of FIG. 11 taken at the section 12—12.
Figures 13, 14, 15:
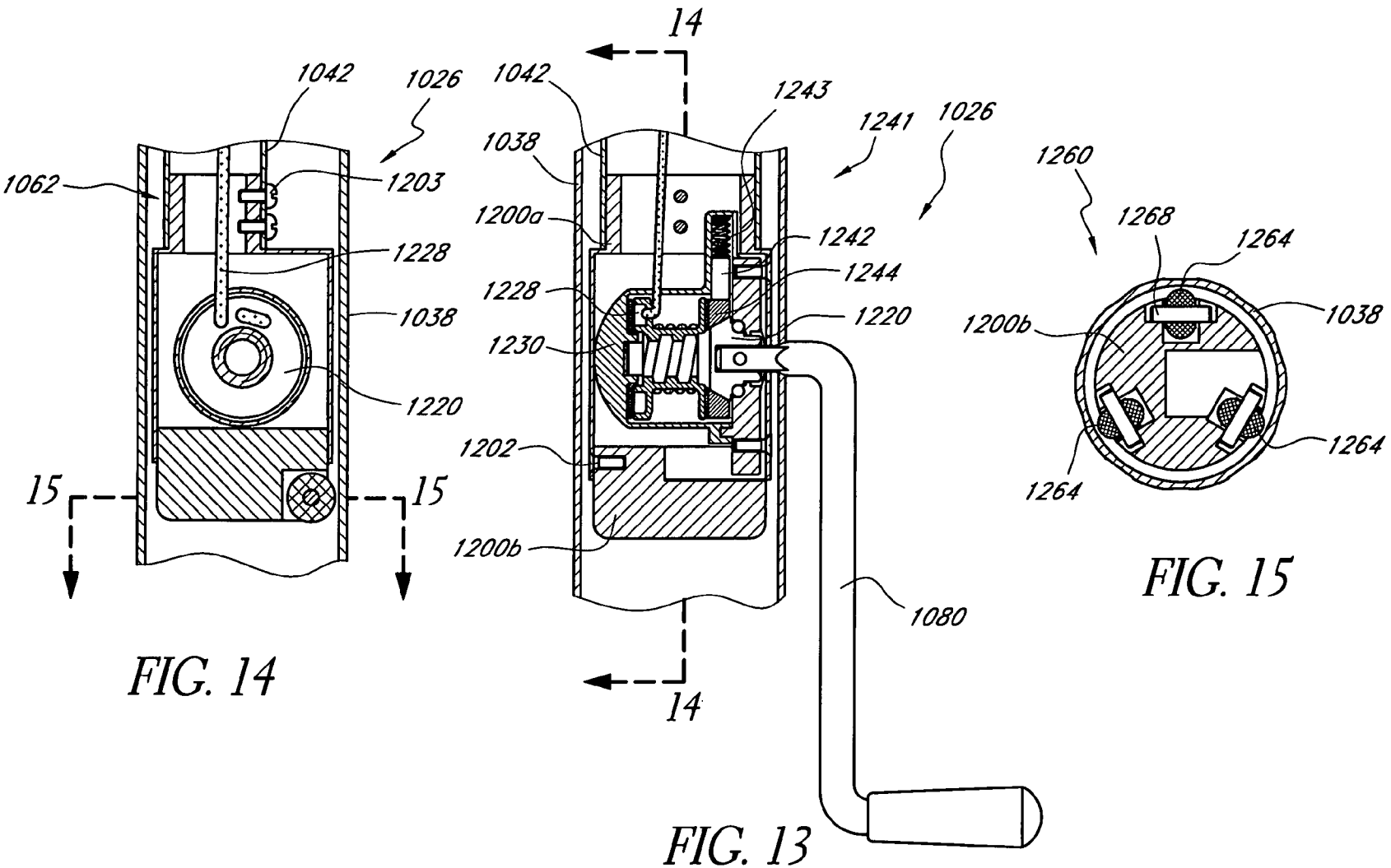
FIG. 13 is a cross-section view of a canopy deployment mechanism of one variation of the umbrella of FIG. 10.
FIG. 14 is a cross-section view of the canopy deployment mechanism shown in FIG. 13 taken at section 14—14.
FIG. 15 is a cross-section view of the canopy deployment mechanism shown in FIG. 13 taken at section 15—15.

FIGS. 11–13 illustrate various embodiments of the extension mechanism 1022. The extension mechanism 1022 can take any suitable form and can be coupled with the support pole 1018 at any convenient location, e.g., at a midpoint of an arcuate or curved section of the first member 1038. In one embodiment, the extension mechanism 1022 is located on the inside (e.g., on the concave side) of the curved portion of the first member 1038. In one embodiment, an extension mechanism housing 1052 is coupled with the first member 1038. In one embodiment, the extension mechanism housing includes a first portion 1052*a* that partially surrounds the first member 1038 and a second portion 1052*b* that is coupled with the first portion 1052*a*. In one embodiment, the first and second portions 1052*a*, 1052*b* are coupled together with a suitable fastener, such as a screw 1054. This arrangement enables the extension mechanism housing 1052 to be disassembled so that components housed therein can be easily accessed for service or repair.

In one embodiment, the extension mechanism 1022 includes a crank handle 1080, a shaft assembly 1084, a drive member 1088 coupled with the shaft assembly, and a driven member 1092. The shaft assembly 1084 can be mounted to the support pole 1018 in any suitable manner. In one arrangement, the extension mechanism housing 1052 is provided with a shaft mounting portion 1104. The shaft mounting portion 1104 includes a shaft passage 1108 extending generally transverse the extension mechanism housing 1052, e.g., between internal surfaces of the first and second portions 1052*a*, 1052*b*. The shaft passage 1108 preferably is at least partially enclosed by a wall 1110. The wall 1110 can have a shape corresponding to the shape of the drive member 1084 or any other component of the extension mechanism 1022. In one arrangement, the shaft passage 1108 is accessible at first end by removing the housing portion 1052*b*.

The shaft assembly 1084 can take any suitable form. One embodiment of the shaft assembly 1084 includes a shaft 1128 journaled for rotation within housing 1052 or the passage 1108. For example, one or more bearings can be mounted in the shaft passage 1108 about the shaft 1128 to facilitate rotation of the shaft. The shaft 1128 is configured to rotate about an axis B1 extending generally transversely to a longitudinal axis B2 of the support pole 1018, e.g., of the second member 1042. The shaft 1128 is configured such that the drive member 1088 can be mounted thereon. In one embodiment, a mounting member 1130 is coupled with the shaft 1128. The mounting member 1030 is coupled with the shaft 1128 such that rotation of the shaft 1128 causes the mounting member 1130 also to rotate. The drive member 1088 preferably is coupled with the mounting member 1130, e.g., with a fasteners 1132. As the mounting portion 1130 is rotated by the shaft 1128, the drive member 1088 also rotates.

The shaft 1128 preferably also has a cranking engagement portion 1136, which may be a recessed formed to receive an end of the crank handle 1080. For example, the end of the crank handle 1080 and the recess 1136 can each have a matching shape as described above in connection with the embodiment of FIGS. 1–10. Additionally, a detent arrangement 1138 can be provided to facilitate engagement of the crank handle 1080 and the shaft 1128.

The driven member 1092, which can be a gear rack, as discussed above, preferably is coupled with the second member 1042. As discussed above, second member 1042 has a curved section. Preferably the driven member 1092 is coupled with the second member 1042 within the curved section of the second member 1042. The driven member 1092 is configured to engage the drive member 1084 and to be driven thereby upon rotation of the drive member 1084. As discussed above, the drive member 1084 may be rotated by the crank handle 1080.

FIGS. 13–15 illustrate further details of one embodiment of the canopy deployment mechanism 1026. The canopy deployment mechanism 1026 is coupled with an end portion of the second member 1042 in one arrangement. In one embodiment, a portion of the canopy deployment mechanism 1026 is coupled with the second member 1042 adjacent to the first end 1062. In one embodiment, a deployment mechanism housing 1200 is provided to house a portion of the canopy deployment mechanism 1026. The housing 1200 can include a first housing member 1200*a* and a second housing member 1200*b* that can be coupled together in a suitable fashion, e.g., using a suitable fastener, such as a screw 1202. The first housing member 1200*a* can be coupled with the second member 1042 in any suitable manner, e.g., using a suitable fastener, such as one or more screws 1203. Additional components of the canopy deployment mechanism 1026 extend from the first end 1062 of the second member 1042 toward the canopy frame 1014.

The canopy deployment mechanism 1026 can take any suitable form. In one embodiment, the canopy deployment mechanism 1026 includes a drum 1220 rotatably journaled on the support pole 1018. The drum 1220 is journaled on the second member 1042 in one embodiment. An illustrated embodiment, the drum 1220 is journaled in the deployment mechanism housing 1200. The drum 1220 preferably has a crank engagement portion 1224 and is configured to have wound thereabout tension member 1228. In one embodiment, the drum 1220 is housed within a drum housing 1230. The drum housing 1230 is configured to be mounted within the deployment mechanism housing portion 1200*a*, e.g., with one or more fasteners. Also mounted within the housing 1230 in one embodiment is a ratchet device 1241 that includes a rigid member 1242 and a resilient member 1243. The rigid member 1242 is configured to engage a flange 1244 that extends radially from the drum 1220 at an end thereof adjacent to the crank engagement portion discussed below.

To facilitate movement of the second member 1042 within the first member 1038, one or more bearings may be provided. FIG. 15 illustrates one embodiment wherein a bearing arrangement 1260 is provided adjacent to the first end 1062 of the second member 1042. In one embodiment, the bearing arrangement 1260 includes one or more roller bearings 1264 journaled for rotation and configured to extend from the second housing member 1200*b* to an inner surface of the first member 1038. The roller bearings 1264 are journaled for rotation on a shaft 1268 in one embodiment. A shaft 1268 is journaled for rotation within the second housing member 1200*b* in one embodiment. The roller bearings 1264 cause the second housing member 1200*b* to be spaced a uniform amount from the inner surface of the first member 1038 as the second member 1042 is extended from and retracted into the first member 1038. In addition to the bearing arrangement 1260, another bearing arrangement can be provided near the second end 1050 of the first member 1038 to facilitate movement of the second member 1042 relative to the first member 1038. Such an arrangement could be similar to that shown in FIGS. 7–8 above.

FIG. 13 shows that access for the crank handle 1080 should be provided to the crank engagement portion 1224. As discussed above, the umbrella 1006 is configured such that the second member 1042 moves within the first member 1038. In one embodiment, the first end 1062 of the second member 1042 is housed within the first member 1038 throughout the movement of the second member 1042. To provide access to the crank engagement portion 1224, an aperture can be provided in the first member 1038 that is larger than the end of the crank handle 1080 that engages the crank engagement portion 1224. In one embodiment, a plurality of apertures can be provided in the first member 1038 so that the canopy deployment mechanism 1026 can be operated at a plurality of discrete locations of the support pole 1018, e.g., at a variety of extension or retraction positions. In another variation, a slot can be formed in the first member 1038 so that the canopy deployment mechanism 1026 can be operated along a continuous range of locations on the support pole 1018.

Although the foregoing description of the preferred embodiment of the present invention has shown, described, and pointed out the fundamental novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. An umbrella assembly comprising:

a canopy frame;

a support pole comprising:

a first elongate member having a first end and a second end;

a second elongate member having a first end and a second end, said second end being coupled with the canopy frame, the second elongate member being coupled with the first elongate member and movable relative to the first elongate member between a retracted position and an extended position;

an extension mechanism coupled with the support pole and configured to be driven by a crank handle to move the second elongate member between the retracted position and the extended position; and a canopy deployment mechanism coupled with the support pole and configured to be driven by a crank handle independently of the extension mechanism to open and close the canopy frame.

2. The umbrella assembly of claim 1, further comprising a crank handle capable of driving the canopy deployment mechanism and the extension mechanism.

3. The umbrella assembly of claim 1, further comprising an extension mechanism housing coupled with the first elongate member, said extension mechanism further comprising:

a shaft journaled for rotation within the extension mechanism housing, the shaft having a crank engagement portion;

a drive member coupled with the shaft;

a driven member coupled with the second elongate member and configured to engage the drive member and to be driven thereby upon rotation of the shaft; and a crank configured to engage the crank engagement portion such that a force applied to the crank rotates the shaft.

4. The umbrella assembly of claim 3, wherein the drive member is a pinion gear and the driven member is a gear rack coupled with the outer surface of the second elongate member.

5. The umbrella assembly of claim 1, wherein the first elongate member comprises a cylindrical curved pole enclosing a passage, and wherein the second elongate member comprises a curved pole at least partially received within the passage.

6. The umbrella assembly of claim 1, wherein the second elongate member comprises a recess configured to house at least a portion of the extension mechanism.

7. The umbrella assembly of claim 5, wherein the second elongate member projects outside the passage in the first elongate member in at least one of the retracted and the extended positions.

8. The umbrella assembly of claim 1 wherein the second elongate member is longer than the first elongate member.

9. The umbrella assembly of claim 5, wherein the first end of the second elongate member is located inside the passage in the first elongate member in the retracted position.

10. The umbrella assembly of claim 1, wherein the first elongate member comprises a substantially vertical portion configured to be coupled with a base at a first end and a tubular portion coupled with a second end of the substantially vertical portion, the tubular portion defining a passage in which the second elongate member travels between the extended and retracted positions, the extension mechanism located adjacent to the first end of the substantially vertical portion.

11. The umbrella assembly of claim 10, further comprising a base coupled with the substantially vertical member.

12. The umbrella assembly of claim 1, wherein the canopy deployment mechanism further comprises:

a drum rotatably journaled on the support pole, the drum having a crank engagement portion;

a tension member having a first end coupled with the drum and a second end coupled with the canopy frame;

a ratchet device that engages the drum to selectively prevent rotation of the drum; and a crank configured to engage the crank engagement portion such that a force applied to the crank rotates the drum whereby a force is applied to the tension member, the force being transmitted by the tension member to the canopy frame to cause the canopy frame to open and close.

13. The umbrella assembly of claim 1, further comprising a hinge located between the canopy frame and the second elongate member of the support pole, the hinge enabling a central portion of the canopy frame to extend generally perpendicular to the second elongate member when the canopy is open and to hang adjacent to the second elongate member when the canopy is closed.

14. The umbrella assembly of claim 1, further comprising a canopy fabric coupled with an upper portion of the canopy frame.

15. The umbrella assembly of claim 1, wherein the canopy frame further comprises a rib having an upper end, a lower end with a passage, and a movable member, the movable member being movably coupled with the lower end such that the length of the rib can be increased.

16. The umbrella assembly of claim 15, wherein the rib further comprises a resilient member within the passage configured to urge the movable member toward a lower end of the passage.

17. An umbrella assembly comprising:

a support pole comprising:

a first elongate member having an outer surface and an inner surface at least partially surrounding a space;

a second elongate member at least partially extending within the space;

a driven member coupled with the second elongate member and facing the inner surface of the first elongate member; and a drive member configured to apply a force to driven member in response to rotation of a crank handle whereby the second elongate member can be moved relative to the first elongate member; and a canopy frame coupled with the second elongate member.

18. The umbrella assembly of claim 17, wherein the driven member comprises a plurality of gear teeth.

19. The umbrella assembly of claim 17, wherein the driven member comprises a gear rack.

20. The umbrella assembly of claim 17, wherein the drive member comprises a pinion gear.

21. The umbrella assembly of claim 17, wherein the first elongate member comprises an extension mechanism housing and further comprising a third elongate member comprising a first end coupled with the extension mechanism housing and a second end configured to be coupled with an umbrella base.

22. The umbrella assembly of claim 17, further comprising a canopy deployment mechanism configured to be driven by a crank handle to open and close the canopy.

23. The umbrella assembly of claim 22, wherein the second elongate member comprises a passage and the canopy deployment mechanism comprises a tension member extending through the passage to the second end of the second elongate member.

24. The umbrella assembly of claim 23, wherein the canopy deployment mechanism comprises a crank handle and a barrel coupled with the crank handle and the tension member, wherein rotation of the crank handle winds the tension member onto or unwinds the tension member from the barrel.

25. The umbrella assembly of claim 17, further comprising a canopy fabric coupled with an upper portion of the canopy frame.

26. The umbrella assembly of claim 17, wherein the canopy frame further comprises a rib having an upper end, a lower end with a passage, and a movable member, the movable member being movably coupled with the lower end such that the length of the rib can be increased.

27. The umbrella assembly of claim 26, wherein the rib further comprises a resilient member within the passage configured to urge the movable member toward a lower end of the passage.

28. The umbrella assembly of claim 17, wherein the first elongate member comprises a curved pole enclosing a passage, and wherein the second elongate member comprises a curved pole at least partially received within the passage.

29. The umbrella assembly of claim 28, further comprising a canopy deployment mechanism, wherein the second elongate member comprises a first end and a second end, said second end being coupled with the canopy frame, said canopy deployment mechanism being coupled with said first end, said first end projecting out of said passage.

30. The umbrella assembly of claim 28, further comprising a canopy deployment mechanism, wherein the second elongate member comprises a first end and a second end, said second end being coupled with the canopy frame, said canopy deployment mechanism being coupled with said first end, said first elongate member comprising an access aperture through which a crank handle may be extended to engage the canopy deployment mechanism.

31. The umbrella assembly of claim 30, further comprising a plurality of apertures through which a crank handle may be extended to engage the canopy deployment mechanism.

32. The umbrella assembly of claim 30, wherein the aperture is elongated such that a crank handle may be extended therethrough to engage the canopy deployment mechanism over a continuous range of positions.

33. The umbrella assembly of claim 28, further comprising a canopy deployment mechanism.

34. An umbrella assembly comprising:

a canopy frame;

a support pole comprising:

a curved pole portion having an upper end coupled with the canopy and a lower end, a first pole portion having a lower end, an upper end, and a longitudinal axis, the first pole portion defining a passage through which the curved pole portion can be moved generally transversely to the longitudinal axis of the first pole portion;

an extension mechanism coupled with the support pole and configured to be driven by a crank handle to move the curved pole portion between a retracted position and an extended position; and a canopy deployment mechanism coupled with the support pole and configured to be driven by a crank handle independently of the extension mechanism to open and close the canopy frame;

wherein the lower end of the curved pole is located outside the first pole portion when the curved pole is in the retracted position.

35. An umbrella comprising:

the umbrella assembly of claim 34;

a base to which the lower end of the first pole portion is coupled;

a canopy including the canopy frame and a canopy fabric;

the extension mechanism being at least partially housed within an extension mechanism housing, the extension mechanism housing being located at the upper end of the first pole portion, the passage through which the curved pole can be moved being located in the extension mechanism housing, the extension mechanism further comprising:

a pinion gear mounted in the extension mechanism housing to rotate about an axis extending generally transversely to the longitudinal axis of the first pole portion; and a rack coupled with the curved pole and configured to be driven by the pinion gear such that rotation of the pinion gear is converted to translation of the curved pole within the passage; and a canopy deployment mechanism coupled with the support pole adjacent the lower end of the curved pole, the canopy deployment mechanism comprising:

a shaft mounted adjacent to the enclosed space of the curved pole;

a tension member having a lower end coupled with the shaft and an upper end coupled with the canopy frame;

a crank configured to engage the extension mechanism and the canopy deployment mechanism.

36. The umbrella of claim 35, further comprising a gear shaft journaled in the extension mechanism housing on which the pinion gear is mounted.

37. The umbrella of claim 35, wherein the canopy deployment mechanism further comprises a ratchet device and a drum mounted on the shaft and coupled with the lower end of the tension member, the ratchet device configured to engage the drum to selectively prevent the drum and the shaft from rotating.

38. The umbrella of claim 35, wherein the canopy frame further comprises a rib having an upper end, a lower end, and a movable member, the movable member being movably coupled with the lower end such that the length of the rib can be increased.

39. The umbrella of claim 38, wherein the rib further comprises a resilient member within the passage configured to urge the movable member toward a lower end of the passage.

40. The umbrella of claim 35, further comprising a brake system comprising a resilient member configured to engage the extension mechanism housing and a brake engagement member coupled with the crank, the brake engagement member configured to compress the resilient member by rotation of the crank to disengage the resilient member from the extension mechanism housing.

41. The umbrella assembly of claim 34, further comprising a brake system configured to limit movement of the curved pole portion relative to the first pole portion.

* * * * *